US006883565B2

(12) United States Patent
Marui

(10) Patent No.: US 6,883,565 B2
(45) Date of Patent: Apr. 26, 2005

(54) AIR PUMP FOR BICYCLES

(75) Inventor: Shinji Marui, Kobe (JP)

(73) Assignee: Marui Co. Ltd., Hyogo-ken (JP)

( * ) Notice: Subject to any disclaimer, the term of this patent is extended or adjusted under 35 U.S.C. 154(b) by 0 days.

(21) Appl. No.: 10/408,230

(22) Filed: Apr. 8, 2003

(65) Prior Publication Data

US 2003/0192619 A1 Oct. 16, 2003

(51) Int. Cl.[7] ..... B65B 31/00

(52) U.S. Cl. ..... 141/618; 141/38; 141/54; 141/231; 141/301

(58) Field of Search ..... 141/18, 27, 38, 141/47, 52, 54, 231, 301

(56) References Cited

U.S. PATENT DOCUMENTS 3,934,622 A * 1/1976 Vitack et al. ..... 141/18
5,010,928 A * 4/1991 Ballas ..... 141/64
6,267,161 B1 * 7/2001 Barbieri ..... 141/383

* cited by examiner

*Primary Examiner*—Gregory L. Huson
*Assistant Examiner*—Peter deVore
(74) *Attorney, Agent, or Firm*—Fitch, Even, Tabin & Flannery

(57) ABSTRACT

An air pump for bicycles comprises: an air storage tank 5 for storing compressed air which is charged thereinto from a manual pump 30 through tank-charging passages 43*b* and 43*a*; an air-charge valve 44 or 49 for preventing air stored in the air storage tank 5 from reversely flowing toward the manual pump 30 through the tank-charging passages 43*b* and 43*a*; air passages 43*a* and 43*c* which extends from the air storage tank 5 and which is formed at its tip end with an air discharge port which charges air into a bicycle tire; and an opened and closed valve for opening and closing the air passages 43*a* and 43*c*. With this structure, it is possible to provide an air pump for bicycles capable of swiftly charging a large volume of high-pressure air into a bicycle tire.

3 Claims, 6 Drawing Sheets

34
35
5
3
50
30
33
32
52
51
41b
41a
31
43a
49
42
43c
43b
40
44
45

PRIOR ART

PRIOR ART

AIR PUMP FOR BICYCLES

BACKGROUND OF THE INVENTION

1. Field of the Invention

The present invention relates to an air pump for bicycles, and more particularly to an air pump for bicycles having an air storage tank which can be repeatedly filled with air.

2. Disclosure of the Prior Art

As shown in FIG. 5, a general manual air pump for bicycles, which is used for pumping air into a bicycle tire, comprises a cylinder 30, an air discharge port 42 which is an exit for air in the cylinder 30, a piston 32 which is slidably moved in the cylinder 30, and a piston rod 33 connected to the piston 32.

FIG. 6 shows an air charger capable of charging air into the bicycle tire for a short time. Herein, high-pressure gas is charged into a disposable air storage tank 5. A connection port 51 is formed in a tip end of the air storage tank 5. A discharge-adjusting valve 4 is detachably connected to the connection port 51. Gas is charged into the bicycle tire from the air discharge port 42 of the discharge-adjusting valve 4.

In the case of the air pump for bicycles shown in FIG. 5, however, since an amount of air which can be pumped by one pumping operation is small, it is difficult to use this air pump for a tubeless tire in which a large volume of air is pumped and adhesion of a fitted portion between a rim and the tire must be maintained. Therefore, in actually, the manual air pump for bicycles is not frequently used for charging air into the tubeless tire, and in generally, a compressor is used for the same purpose in many cases.

The air charger shown in FIG. 6 is disposable, it is necessary to buy a new air charger whenever the air charger is finished to use, and if a new air charger is not ready when necessary, the compressor must be used to charge air like the above case.

SUMMARY OF THE INVENTION

It is an object of the present invention to provide an air pump for bicycles capable of swiftly charging a large amount of high-pressure air into a bicycle tire.

In order to achieve the object, the present invention provides an air pump for bicycles comprising: an air storage tank for storing compressed air which is charged thereinto from a manual pump through a tank-charging passage; an air-charge valve for preventing air stored in the air storage tank from reversely flowing toward the manual pump through the tank-charging passage; an air passage which extends from the air storage tank and which is formed at its tip end with an air discharge port which charges air into a bicycle tire; and an opened and closed valve for opening and closing the air passage.

Compressed air is charged into the air storage tank from the manual pump through the tank-charging passage, and the compressed air is stored in the air storage tank. In this air-reserved state, the compressed air in the air storage tank is prevented from reversely flowing toward the manual pump by the air-charge valve. With this, the compressed air is held in the air storage tank.

Next, when air is charged into the bicycle tire, the air discharge port provided on the tip end of the air passage extending from the air storage tank is connected to the tire valve, and the opened and closed valve which opens and closes the air passage is opened.

Then, the compressed air in the air storage tank is charged into the bicycle tire through the opened valve.

Since the present invention has the above-described structure, the following specific effects can be exhibited.

Since compressed air is previously reserved in the air storage tank using the manual pump, a large amount and high pressure air can swiftly be charged into the bicycle tire from the air storage tank. Even if the air storage tank becomes empty, compressed air can be repeatedly charged from the manual pump, and it is unnecessary to repeatedly buy a tank unlike the disposable tank.

In the air pump for bicycles of the above structure, the tank-charging passage includes a common passage extending from the air storage tank, and a first branch passage branching from a tip end of the common passage and connected to the manual pump, the air passage includes the common passage, and a second branch passage branching from the tip end of the common passage and connected to the air discharge port, and a switch valve which functions as the air-charge valve and the opened and closed valve is provided on a confluent point between the first branch passage and the second branch passage, the switch valve being switched between a first switch state where the first branch passage and the common passage are brought into communication with each other and a second switch state where the second branch passage and the common passage are brought into communication with each other.

With the structure, if the switch valve is switched into the first switch state where the first branch passage and the common passage are brought into communication with each other, a tank-charging passage connecting the manual pump and the air storage tank with each other is formed. Therefore, in this state, compressed air can be charged into the air storage tank from the manual pump. If the switch valve is switched into the second switch state where the second branch passage and the common passage are brought into communication with each other, an air passage connecting the air discharge port and the air storage tank with each other is formed. Therefore, in this state, it is possible to charge air into the bicycle tire.

In the second switch state, the first branch passage on the manual pump side and the common passage on the air storage tank side are interrupted. With this, it is possible to prevent air reserved in the air storage tank from reversely flowing toward the manual pump.

The one switch valve can function as the air-charge valve and the opened and closed valve in the above structure. Therefore, there is effect that it is possible to reduce the number of parts and to simplify the structure correspondingly as compared with a case where the air-charge valve and the opened and closed valve are separately provided.

Further, in the air pump for bicycles of the above structure, the switch valve may also be switched into a third switch state where the first branch passage and the second branch passage are brought into communication with each other. With this structure, if the switch valve is switched into the third switch state, a path connecting the manual pump→the first branch passage→switch valve→second branch passage→air discharge port (portion through which air is charged into the bicycle tire) in this order is formed. Therefore, even when the air storage tank is empty, it is possible to add air to a slightly deflated bicycle tire from the manual pump.

Other object, features, aspects and advantages of the invention will become more apparent from the following detailed description of embodiments with reference to the accompanying drawings and appended claims.

DETAILED DESCRIPTION OF THE EMBODIMENT

Next, an embodiment of the present invention will be described in detail with reference to the drawings.

Figure 1:
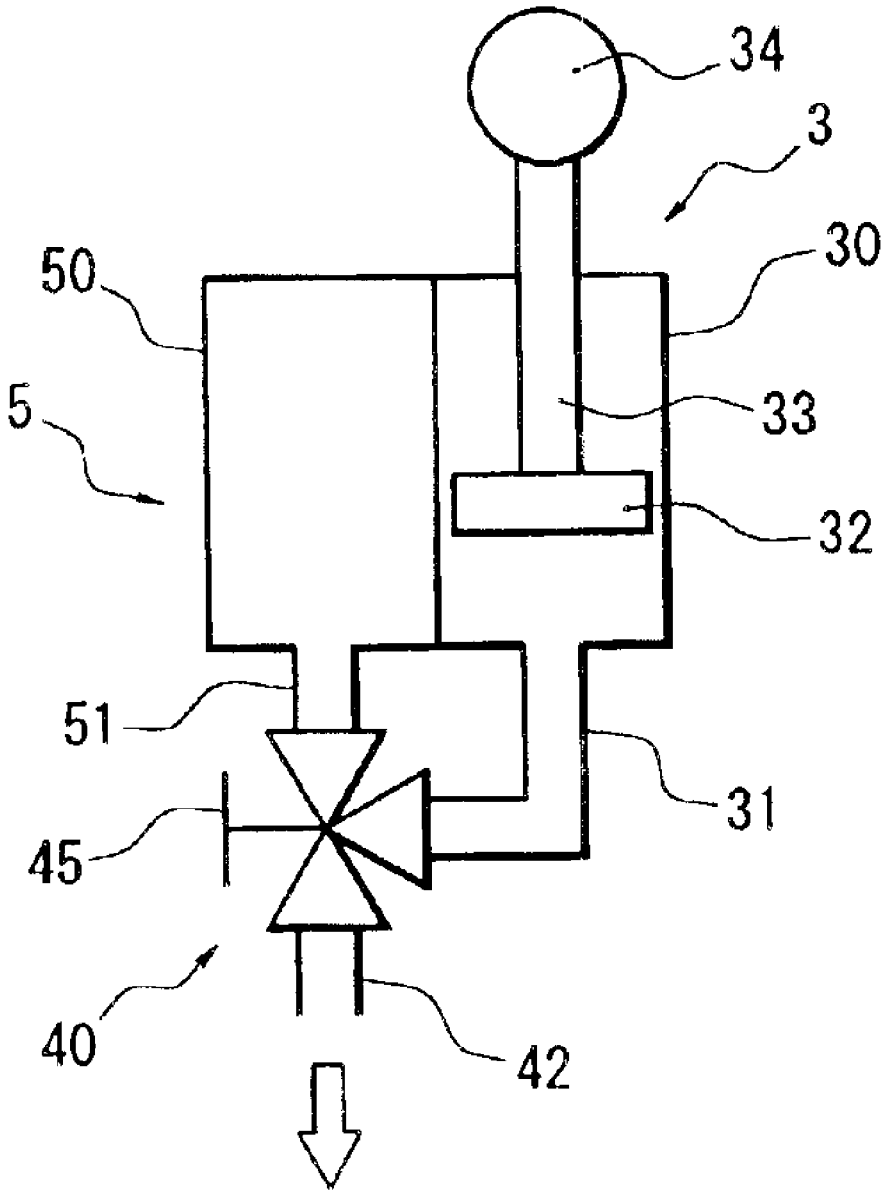
FIG. 1 is a conceptual diagram showing an air pump for bicycles according to an embodiment of the present invention.

FIG. 1 is a conceptual diagram showing an air pump for bicycles according to an embodiment of the present invention. The air pump for bicycles comprises an air storage tank 5 for charging compressed air, a manual pump 3 for manually charging air into a bicycle tire, and a switch valve 40 to which the air storage tank 5 and the manual pump 3 are connected. The switch valve 40 has an air discharge port 42 for air in the air storage tank 5 and the manual pump 3. The switch valve 40 functions as an air-charge valve and an opened and closed valve which is defined in the aspect of the present invention.

Figure 2:
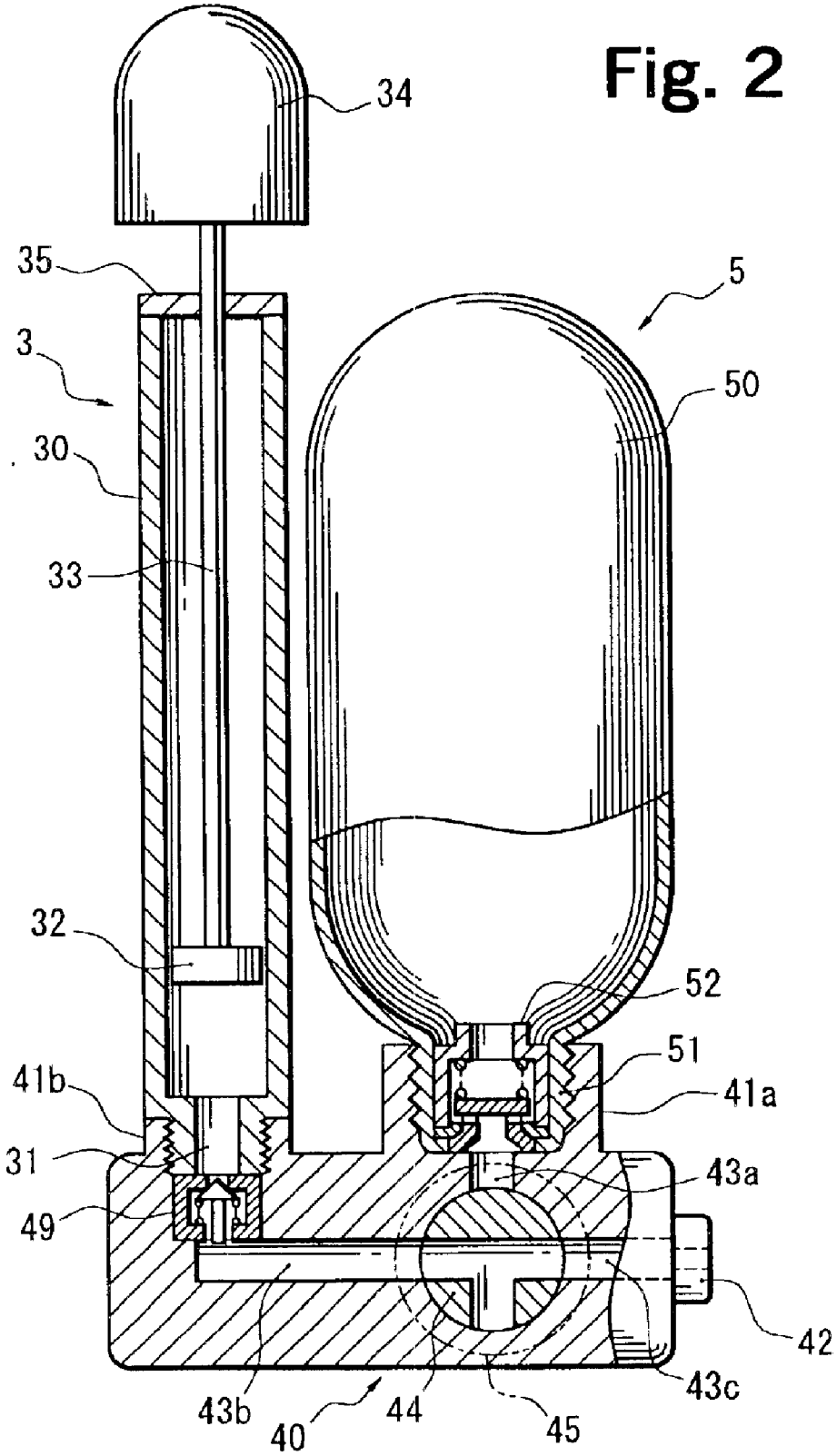
FIG. 2 is a partial sectional view showing the air pump for bicycles according to the embodiment of the present invention.

Details of each portion will be described below in accordance with FIG. 2.

Air Storage Tank 5

The air storage tank 5 includes a tank portion 50 capable of storing compressed air, and a connection port 51. The connection port 51 is provided with a check valve 52 which is set such that the check valve 52 is opened when the air storage tank 5 is connected to the switch valve 40 and the check valve 52 is closed when the air storage tank 5 is detached.

Manual Pump 3

The manual pump 3 for charging compressed air into the air storage tank 5 includes a cylinder 30, a piston 32 inserted in the cylinder 30, a piston rod 33 connected to an upper surface of the piston 32, and a grasping portion 34 connected to the other end of the piston rod 33. The piston rod 33 is passed through an annular plug 35 formed on a rear end of the cylinder 30. Therefore, the piston 32 slidably moves in the cylinder 30 by reciprocating the grasping portion 34. The cylinder 30 is formed at its tip end with an air-supply port 31 for discharging air in the cylinder 30.

Switch Valve 40

The switch valve 40 includes a first air-supply port 41*a* to which the connection port 51 of the air storage tank 5 is connected, a second air-supply port 41*b* to which the air-supply port 31 of the manual pump 3 is connected, and an air discharge port 42 for discharging the compressed air in the tank portion 50 or air in the cylinder 30.

A tank-side air passage 43*a* extends from the first air-supply port 41*a* and functions as a passage for compressed air of the air storage tank 5. The tank-side air passage 43*a* corresponds to a common passage which is defined in the aspect of the present invention. The tank-side air passage 43*a* is connected to a second branch passage 43*c* which is connected to the air discharge port 42 from a valve body 44. A first branch passage 43*b* extending from the second air-supply port 41*b* is connected to the second branch passage 43*c* through the valve body 44. The first branch passage 43*b* is provided with a check valve 49. Two valves, i.e., the check valve 49 and the valve body 44 prevent compressed air in the tank portion 50 from reversely flowing into the cylinder 30 through the first branch passage 43*b* in a duplex manner.

It is only necessary to provide at least one of the check valve 49 and the valve body 44 for preventing the compressed air stored in the tank portion 50 from reversely flowing into the cylinder 30. Therefore, when only a valve which opens or closes the second branch passage 43*c* is provided instead of the valve body 44, the check valve 49 corresponds to the air-charge valve.

The valve body 44 is inserted into a confluent point between the tank-side air passage 43*a* and the first branch passage 43*b*. A turning position of the valve body 44 is adjusted by turning a wheel 45 connected to the valve body 44. With this turning operation, the tank-side air passage 43*a* can selectively brought into communication with the first branch passage 43*b* and the second branch passage 43*c*, and as shown in FIG. 2, the first branch passage 43*b* and the second branch passage 43*c* can be brought into communication with each other.

Therefore, in the present embodiment, the assembly of the tank-side air passage 43*a* and the second branch passage 43*c* as the common passage corresponds to an air passage defined in the aspect of the present invention, and the assembly of the tank-side air passage 43*a* and the first branch passage 43*b* corresponds to a tank-charging passage defined in the aspect of the present invention.

Usage

An example of use of the air pump for bicycles according to the embodiment-in the above structure will be described.

Figure 3:
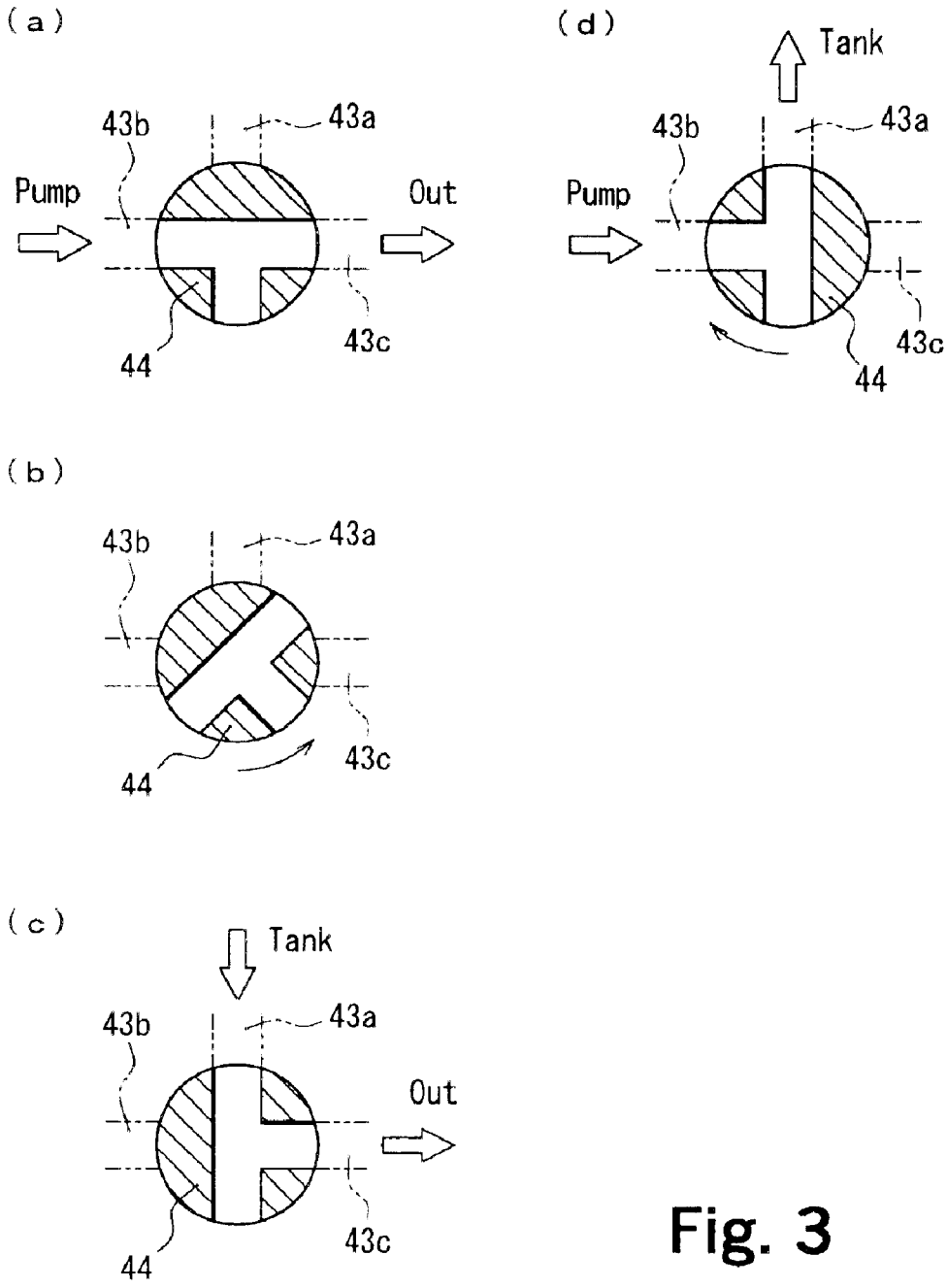
FIGS. 3(*a*) to 3(*d*) illustrate an operation of a valve body 44 of the air pump for bicycles according to the embodiment of the present invention.

First, communication is established in a tank-charging passage including the tank-side air passage 43*a* and the first branch passage 43*b* by switching the valve body 44 into a state shown in FIG. 3(*d*). In this state, the grasping portion 34 is grasped to reciprocate the piston 32, thereby causing the pumping operation, high pressure compressed air is pumped from the manual pump 3 into the tank portion 50 of the air storage tank 5, and the compressed air is stored in the tank portion 50. Then, the valve body 44 of the switch valve 40 is switched to a state shown in FIG. 3(*a*), and the preparation operation is completed.

Next, when air is charged into a deflated bicycle tire, the air discharge port 42 is first connected to a tire valve provided on a rim of the tire.

Thereafter, the valve body 44 is turned in the order of FIGS. 3(*a*), 3(*b*) and 3(*c*), thereby bringing the tank-side air passage 43*a* and the second branch passage 43*c* into communication with each other. In this state, since the check valve 52 of the air storage tank 5 is maintained in its opened state as described above, the compressed air charged in the tank portion 50 of the air storage tank 5 is supplied through a path, i.e., the tank-side air passage 43*a*→the valve body 44→the second branch passage 43*c*→the air discharge port 42. With this compressed air, air is charged into the bicycle tire.

If the compressed air in the air storage tank 5 run out, compressed air may be again charged into the tank portion 50 from the manual pump 3 in the above-described manner. However, when the air storage tank 5 is empty and it is necessary to slightly add air into the bicycle tire, the valve body 44 is switched to the state shown FIG. 3(*a*), and the manual pump 3 is operated in this state, whereby air can be added into the bicycle tire from the manual pump 3.

Figure 4:
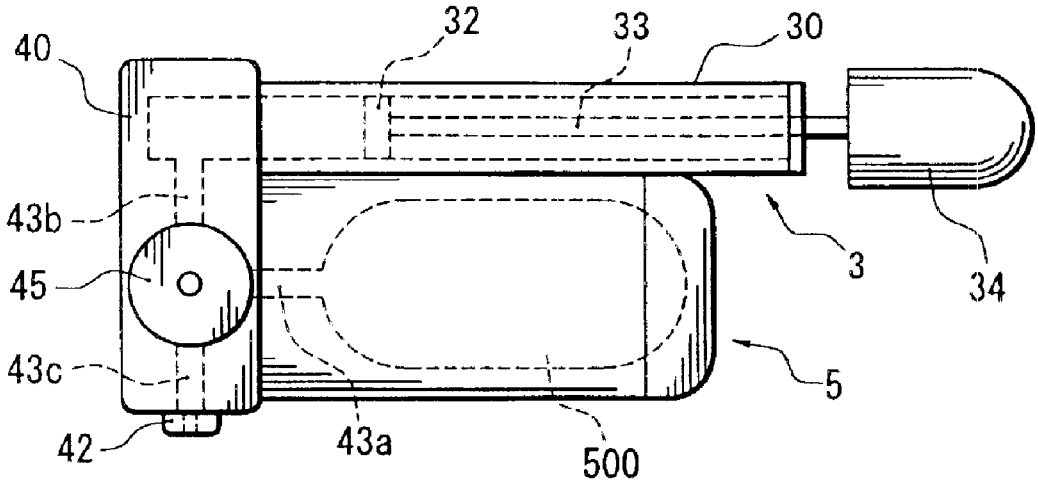
FIG. 4 illustrates a modification of the embodiment of the present invention.
Figure 5:
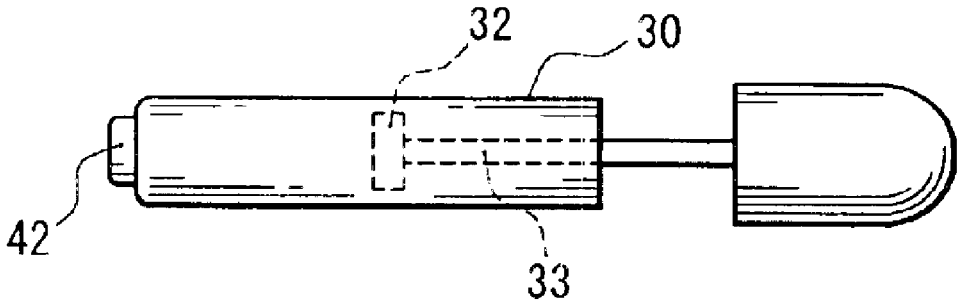
FIG. 5 illustrates prior art.
Figure 6:
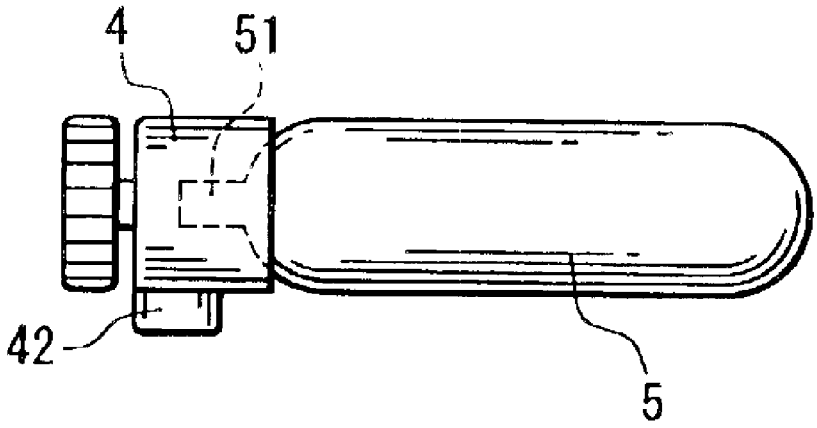
FIG. 6 illustrates another prior art.

Although the air storage tank 5 is detachably connected to the first air-supply port 41*a* of the switch valve 40 which is a mounting portion of the air storage tank 5 in the above first embodiment, an air storage tank 5 having an air storage chamber 500 which is in communication with the tank-side air passage 43*a* may integrally be formed on the switch valve 40 as shown in FIG. 4.

What is claimed is:

1. An air pump for bicycles, comprising:

an air storage tank for storing compressed air which is charged thereinto from a manual pump through a tank-charging passage;

an air-charge valve for preventing air stored in the air storage tank from reversely flowing toward the manual pump through the tank-charging passage;

an air passage which extends from the air storage tank and which is formed at its tip end with an air discharge port which charges air into a bicycle tire; and a valve that can be opened and closed for opening and closing the air passage, wherein the tank-charging passage includes a common passage extending from the air storage tank, and a first branch passage branching from a tip end of the common passage and connected to the manual pump, the air passage includes the common passage, and a second branch passage branching from the tip end of the common passage and connected to the air discharge port, and a switch valve which functions as the air-charge valve and the opened and closed valve is provided on a confluent point between the first branch passage and the second branch passage, the switch valve being switched between a first switch state where the first branch passage and the common passage are brought into communication with each other and a second switch state where the second branch passage and the common passage are brought into communication with each other.

2. The air pump for bicycles according to claim 1, wherein the switch valve is switched into a third switch state where the first branch passage and the second branch passage are brought into communication with each other.

3. An air pump for bicycles comprising an assembly of the following components:

a manual pump and an air-charge valve connected thereto, an air storage tank for storing compressed air, a switch valve structure to which said manual pump and said air storage tank are connected, said switch valve structure having a first passage connected at one end to said air storage tank, a second passage connected at one end through said air-charge valve to said manual pump, and a discharge passage having a terminus in a tip adapted for charging air into a bycycle tire, said switch valve structure having a valve adapted to be switched selectively from among a position wherein the first and second passages are in communication whereby air can be charged into said air storage tank using said manual pump wherein said air-charge valve prevents compressed air in the air storage tank from reversely flowing back in the manual pump, and a position whereby said first passage and said discharge passage are in communication so that air can be discharged from said air storage tank to charge air into a bicycle tire, and a position whereby said second passage and said discharge passage are in communication whereby the manual pump can be used to pump air through the discharge passage.

* * * * *

UNITED STATES PATENT AND TRADEMARK OFFICE

CERTIFICATE OF CORRECTION

PATENT NO. : 6,883,565 B2
DATED : April 26, 2005
INVENTOR(S) : Shinji Marui

It is certified that error appears in the above-identified patent and that said Letters Patent is hereby corrected as shown below:

Title page,
Insert Item [30]:
-- Foreign Application Priority Data
Apr. 11, 2002 (JP) ..... 2002-109194 --

Signed and Sealed this

Second Day of August, 2005

JON W. DUDAS
*Director of the United States Patent and Trademark Office*